US006357746B1

(12) United States Patent
Sadowski

(10) Patent No.: US 6,357,746 B1
(45) Date of Patent: Mar. 19, 2002

(54) GAMING CHIP WITH BUILT-IN TIMER

(76) Inventor: Craig Sadowski, 3879 Mesa Dr., #204, Oceanside, CA (US) 92056

( * ) Notice: Subject to any disclaimer, the term of this patent is extended or adjusted under 35 U.S.C. 154(b) by 0 days.

(21) Appl. No.: 09/370,375

(22) Filed: Aug. 9, 1999

(51) Int. Cl.[7] ..... A63F 1/18

(52) U.S. Cl. ..... 273/148 R; 273/288; 273/460; 463/47.1; 368/10; 368/98; 368/112; D10/6; D10/7; D10/22

(58) Field of Search ..... D10/6, 7, 8, 22, D10/33–35; 368/10, 97–99, 110–112; 273/148 R, 288, 460; 463/47.1

(56) References Cited

U.S. PATENT DOCUMENTS

| | | | | | |
|---|---|---|---|---|---|
| 3,817,019 | A | * | 6/1974 | Fowler | 368/73 |
| 4,023,345 | A | | 5/1977 | Imamura | 58/39 |
| 4,184,320 | A | | 1/1980 | Kashio | 58/74 |
| D276,219 | S | | 11/1984 | Mox | D10/40 |
| 4,505,595 | A | * | 3/1985 | Rose et al. | 368/110 |
| D284,358 | S | | 6/1986 | Chan | D10/40 |
| 4,597,673 | A | * | 7/1986 | Kihara | 368/80 |
| 4,641,125 | A | * | 2/1987 | Pesa | 368/10 |
| 4,769,797 | A | | 9/1988 | Murakami | 368/111 |
| 4,888,748 | A | * | 12/1989 | Lagasse et al. | 368/107 |
| 4,972,391 | A | | 11/1990 | Juve et al. | 368/10 |
| 5,140,564 | A | * | 8/1992 | Rich | 368/107 |
| 5,651,548 | A | | 7/1997 | French et al. | 273/309 |
| D386,981 | S | | 12/1997 | Chae | D10/33 |
| D395,607 | S | | 6/1998 | Chae | D10/6 |
| 5,895,321 | A | | 4/1999 | Gassies et al. | 463/29 |
| 6,229,764 | B1 | * | 5/2001 | Tongue | 368/110 |

* cited by examiner

*Primary Examiner*—Benjamin H. Layno
(74) *Attorney, Agent, or Firm*—Gary L. Eastman

(57) ABSTRACT

A gaming chip with built-in timer includes a circular cylindrical body with an upper surface, a lower surface, and a continuous sidewall. Additionally, the gaming chip with built-in timer may have a diameter and a thickness that are approximately the same as the diameter and thickness of a standard sized casino gaming chip, which may allow it to be stored in a standard size chip tray. Incorporated into the body of the gaming chip may be a timer, a start button, a stop button, and a reset button. During use, a single gaming chip with built-in timer may be used to mark a seat vacated by a gambler on a break. If more than one gambler vacates his or her seat during a break more than one gaming chip with built-in timer may be used to reserve the empty seats.

20 Claims, 2 Drawing Sheets

GAMING CHIP WITH BUILT-IN TIMER

FIELD OF THE INVENTION

The present invention relates generally to gambling accessories. More specifically, the present invention pertains to casino gaming chips. The present invention is particularly, though not exclusively, useful for a dealer or pit boss to monitor the time that an individual gambler spends away from a gaming table during a break.

BACKGROUND OF THE INVENTION

In the latter half of the twentieth century, legalized gambling has become a huge industry with billions of dollars wagered each year. For many people, gambling is a serious past time that requires a serious investment of time and patience. Many times, in casinos, gamblers will sit at poker and black jack tables for hours and hours deep within a lucky streak or waiting for one to begin. In crowded casinos, seats at these tables may be hard to come by and prospective gamblers may often have to wait for a chance to enter a particular card game.

Unfortunately, when gambling for extended periods of time in casinos, the gamblers will have to take periodic breaks. Many casinos will allow these gamblers to reserve their seats at a table for a set amount of time, e.g., ten minutes (10 min.), fifteen minutes (15 min.), twenty minutes (20 min.), etc. During these breaks, a prospective gambler is prevented from taking someone's seat while he or she briefly steps away from the table.

In order to be fair to the waiting gamblers, the dealers have to monitor the elapsed time for someone's break, so that the breaking gamblers will not be away from the tables too long. This monitoring must be done while the dealer continues to deal, collect chips, pay out chips and otherwise maintain order on the casino floor. Because of all these distractions, however, it becomes difficult to accurately monitor the elapsed time for a particular gambler's break from the table. Moreover, it becomes more difficult to maintain the elapsed break time for more than one gambler at a time.

In response to the above problems, there is a need for a device that can be used to accurately monitor the elapsed time for a gambler's break from a gaming table. There is also a need for a device that can be used to accurately monitor the break time for more than one gambler at a time. Finally, there is a need for a device for monitoring the break time of gamblers that can be easily dispensed, retrieved and stored by the casino dealers.

Accordingly, it is an object of the present invention to provide a gaming chip with built-in timer that will accurately maintain the break time of individual gamblers. It is another object of the present invention to provide a gaming chip with built-in timer that is unobtrusive. It is another object of the present invention to provide a gaming chip with built-in timer that will fit in standard sized gaming chip storage trays in order to facilitate their storage. It is yet another object of the present invention to provide a gaming chip with built-in timer that is easy to manufacture, easy to use, and relatively inexpensive.

SUMMARY OF THE PRESENT INVENTION

The gaming chip with built-in timer of the present invention includes a circular cylindrical body with an upper surface, a lower surface, and a continuous sidewall. Additionally, the gaming chip with built-in timer has a diameter and a thickness that are approximately the same as the diameter and thickness of a standard sized casino gaming chip, which allows it to be stored in a standard size chip tray.

Incorporated into the body of the gaming chip is a timer, a start button, a stop button, and a reset button. Each of these is oriented so that it faces upward and each may be flush with the top surface of the circular cylindrical body. The timer may either be a count-down timer or a count-up timer with a LED or LCD display. The timer may be activated by pressing the start button and deactivated by pressing the stop button. If necessary, the timer may be reset by pressing the reset button.

The gaming chip with built-in timer may also include an alarm which transmits an audible beep through a hole formed in the upper surface of the circular cylindrical body. During use, a single gaming chip with built-in timer may be used to mark a seat vacated by a gambler on a break. If more than one gambler vacates his or her seat during a break more than one gaming chip with built-in timer may be used to reserve the empty seats.

The gaming chip with built-in timer of the present invention overcomes the problems mentioned above because it provides an unobtrusive device that can be used to accurately track the break time of one or more gamblers. Moreover, the gaming chip with built-timer of the present invention provides a device that will fit in standard sized gaming chip trays to facilitate their storage. Finally, the gaming chip with built-in timer provides a device that is easy to manufacture, easy to use, and relatively inexpensive.

DESCRIPTION OF THE DRAWINGS

The novel features of this invention, as well as the invention itself, both as to its structure and its operation, will be best understood from the accompanying drawings, taken in conjunction with the accompanying description, in which reference characters refer to similar parts, and in which.

DETAILED DESCRIPTION OF A PREFERRED EMBODIMENT

Figure 1:
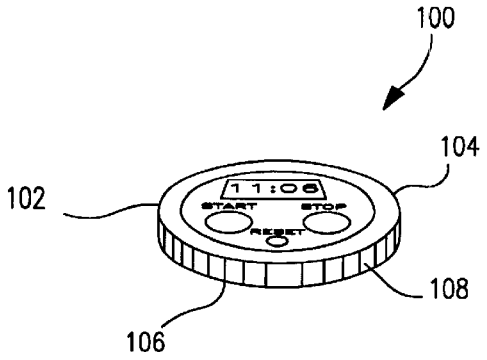
FIG. 1 is a perspective view of the Gaming Chip With Built-In Timer of the present invention.
Figure 2:
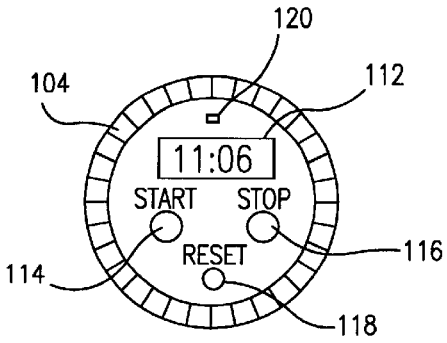
FIG. 2 is a top plan view of the Gaming Chip With Built-In Timer of the present invention.
Figure 3:
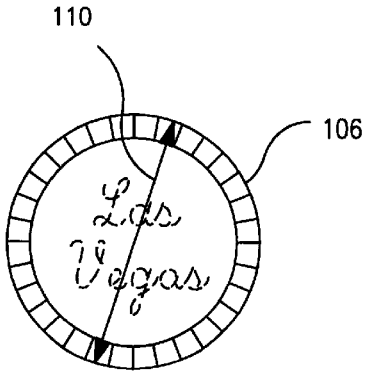
FIG. 3 is a bottom plan view of the Gaming Chip With Built-In Timer of the present invention.
Figure 4:
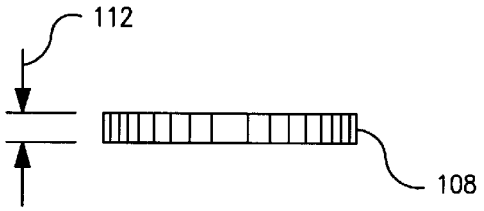
FIG. 4 is a side plan view of the Gaming Chip With Built-In Timer of the present invention.

Referring initially to FIG. 1, the gaming chip with built-in timer is shown and generally designated 100. FIGS. 1 through 4 show that the gaming chip with built-in timer 100 includes a circular cylindrical body 102 with an upper surface 104, a lower surface 106, and a continuous side wall 108. Furthermore, the gaming chip with built-in timer 100 has a diameter 110 and a height 112.

Incorporated into the circular cylindrical body 102 of the gaming chip with built-in timer 100 is a timer 112. In a preferred embodiment, the timer 112 may be flush with the upper surface 104 of the circular cylindrical body 102, and it may be a standard count-up timer with a light emitting diode (LED) display or a liquid crystal diode (LCD) display. It can be appreciated that the timer 112 may be a count-down timer starting at ten minutes (10 min.), fifteen minutes (15 min.), twenty minutes (20 min.), or any other start time chosen by the user. It can also be appreciated that the timer 112 may count-up to variable wait times, such as ten, fifteen, and twenty minutes.

Also incorporated into the circular cylindrical body 102 is a start button 114, a stop button 116, and a reset button 118. These buttons 114, 116, and 118 may each be flush with the upper surface 104 of the gaming chip with built-in timer 100. In a preferred embodiment, the start button 114 may activate the timer 112, the stop button 116 may deactivate the timer 112, and the reset button 118 may reset the timer 112 to zero (0). It can be appreciated that if the timer 112 is a count-down timer, pressing the reset button 118 will return the timer 112 to the chosen upper time, e.g., ten minutes (10 min.), fifteen minutes (15 min.), twenty minutes (20 min.), etc.

The upper surface 104 of the gaming chip with built-in timer 100 may also be formed with a hole 120 through which a signal, such as a beep, may be transmitted by an alarm (not shown) incorporated into the circular cylindrical body 102. The alarm (not shown) may beep when a target time is reached.

In a preferred embodiment, the gaming chip with built-in timer 100 may be manufactured from the same material as standard casino gaming chips, e.g., plastic, but it can be appreciated that any material well known in the art with similar characteristics may be used. Moreover, in a preferred embodiment the diameter 110 and/or height 112 of the gaming chip with built-in timer 100 may be the same as the dimensions of a standard sized casino gaming chip.

A standard sized gaming chip is typically thirty-six to forty millimeters (36–40 mm) in diameter and three to five millimeters (3–5 mm) tall. For the convenience of the gamblers, the dealers, and pit bosses, the dimensions of the gaming chip with built-in timer may allow it to be stored in standard sized casino chip trays.

The bottom surface 106 of the circular cylindrical body 102 may be emblazoned with the logo of the casino in which the gaming chip with built-in timer 100 is used. As such, the gaming chip with built-in timer 100 may be further used for advertisement or it may be passed out to gamblers for winning, or losing, a certain amount of money.

DESCRIPTION OF A FIRST ALTERNATIVE EMBODIMENT

Figure 5:
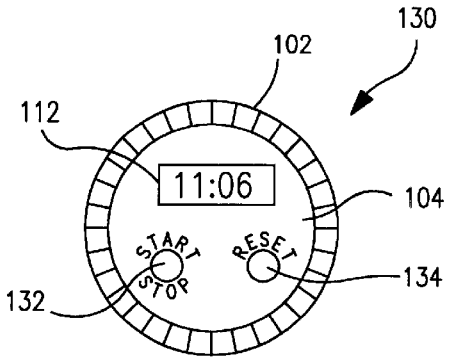
FIG. 5 is a top plan view of a first alternative embodiment of the Gaming Chip With Built-In Timer of the present invention.

Referring now to FIG. 5, a first alternative embodiment of the gaming chip with built-in timer is shown and designated 130. FIG. 5 shows that this embodiment of the gaming chip with built-in timer 130 includes a single start/stop button 132 and a reset button 134 incorporated into the circular cylindrical body 102. Like the preferred embodiment, these buttons 132 and 134 may be flush with the upper surface 104 of the gaming chip with built-in timer 130.

During use, the timer 112 may be activated by pressing the start/stop button 132 once. The timer 112 may then be deactivated by again pressing the start/stop button 132. By pressing the reset button 134, the timer 112 may return to its beginning time, e.g., zero time if it is a count-up timer or an upper threshold time if it is a count-down timer.

DESCRIPTION OF A SECOND ALTERNATIVE EMBODIMENT

Figure 6:
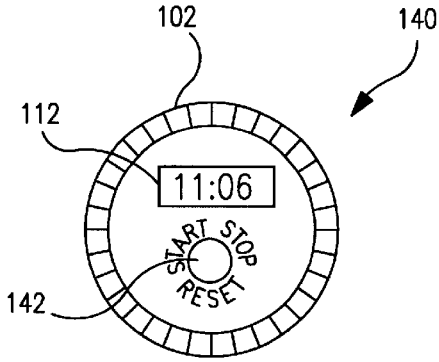
FIG. 6 is a top plan view of a second alternative embodiment of the Gaming Chip With Built-In Timer of the present invention.

Referring now to FIG. 6, a second alternative embodiment of the gaming chip with built-in timer is shown and designated 140. FIG. 6 shows that this embodiment of the gaming chip with built-in timer 140 includes a single start/stop/reset button 142 incorporated into the circular cylindrical body 102. The start/stop/reset button 142 may be installed so that it is flush with the upper surface 104 of the circular cylindrical body 102.

During use, the timer 112 may be activated by pressing the start/stop/reset button 142. The timer 112 may then be deactivated by again pressing the start/stop/reset button 142. Finally, the timer 112 may be reset by depressing the start/stop/reset button 142 and holding it for a short period of time, e.g., one or two seconds.

It can be appreciated that in any of the above described embodiments of the gaming chip with built-in timer, the buttons may be replaced with a mercury switch or a magnetic switch. In either case, the switch may be closed when the gaming chip with built-in timer is placed horizontally on the gaming table surface, thus activating the timer. On the other hand, the timer may be deactivated when the gaming chip with built-in timer is placed vertically in a gaming chip tray and the switch is opened.

While the gaming chip with built-in timer of the present invention as herein shown and disclosed in detail is fully capable of obtaining the objects and providing the advantages herein before stated, it is to be understood that it is merely illustrative of a preferred embodiment and a couple alternative embodiments of the invention and that no limitations are intended to the details of construction or design herein shown other than as described in the appended claims.

I claim:

1. A gaming chip with built-in timer comprising:

a circular cylindrical body having an upper surface, a lower surface, a continuous sidewall, a diameter, and a height;

a timer incorporated into said circular cylindrical body; and a mercury switch within said body and in electrical connection with said timer wherein said mercury switch activates said timer when said body is in a first position, and deactivates said timer when said body is in a second position.

2. The gaming chip with built-in timer of claim 1, further comprising an alarm within said circular cylindrical body such that said alarm will generate an audible beep.

3. The gaming chip with built-in timer of claim 1, wherein said diameter is approximately thirty-six to forty millimeters (36–40 mm).

4. The gaming chip with built-in timer of claim 1, wherein said height is approximately three to five millimeters (3–5 mm).

5. The gaming chip with built-in timer of claim 1, wherein said timer further comprises:

a start button incorporated into said circular cylindrical body, wherein pressing said start button activates said timer;

a stop button incorporated into said circular cylindrical body, wherein pressing said stop button deactivates said timer; and a reset button incorporated into said circular cylindrical body, wherein pressing said reset button resets said timer.

6. The gaming chip with built-in timer of claim 1, wherein said timer further comprises:

a start/stop button incorporated into said circular cylindrical body, wherein pressing said start/stop button a first time activates said timer and pressing said start/stop button a second time deactivates said timer; and a reset button incorporated into said circular cylindrical body, wherein pressing said reset button resets said timer.

7. The gaming chip with built-in timer of claim 1, wherein said timer further comprises:

a start/stop/reset button incorporated into said circular cylindrical body, wherein pressing said start/stop/reset button a first time activates said timer, pressing said start/stop/button a second time deactivates said timer, and pressing said start/stop/button a third time resets said timer.

8. A gaming chip with built-in timer comprising:

a circular cylindrical body having an upper surface formed with an axial bore, a lower surface, a continuous sidewall, a diameter, and a height;

a timer positionable within said bore, wherein said timer is flush with said upper surface; and a mercury switch within said body and in electrical connection with said timer wherein said mercury switch activates said timer when said body is in a first position, and deactivates said timer when said body is in a second position.

9. The gaming chip with built-in timer of claim 8, wherein said diameter is approximately thirty-six to forty millimeters (36–40 mm).

10. The gaming chip with built-in timer of claim 8, wherein said height is approximately three to five millimeters (3–5 mm).

11. The gaming chip with built-in timer of claim 8, wherein said timer further comprises:

a start button incorporated into said circular cylindrical body, wherein pressing said start button activates said timer;

a stop button incorporated into said circular cylindrical body, wherein pressing said stop button deactivates said timer; and a reset button incorporated into said circular cylindrical body, wherein pressing said reset button resets said timer.

12. The gaming chip with built-in timer of claim 8, wherein said timer further comprises:

a start/stop button incorporated into said circular cylindrical body, wherein pressing said start/stop button a first time activates said timer and pressing said start/stop button a second time deactivates said timer; and a reset button incorporated into said circular cylindrical body, wherein pressing said reset button resets said timer.

13. The gaming chip with built-in timer of claim 8, wherein said timer further comprises:

a start/stop/reset button incorporated into said circular cylindrical body, wherein pressing said start/stop/reset button a first time activates said timer, pressing said start/stop/button a second time deactivates said timer, and pressing said start/stop/button a third time resets said timer.

14. A gaming chip with built-in timer comprising:

a circular cylindrical body having an upper surface, a lower surface, a continuous sidewall, a diameter, and a height;

a timer encapsulated within said circular cylindrical body flush with said upper surface; and a mercury switch within said body and in electrical connection with said timer wherein said mercury switch activates said timer when said body is in a first position, and deactivates said timer when said body is in a second position.

15. The gaming chip with built-in timer of claim 14, further comprising an alarm within said circular cylindrical body such that said alarm will generate an audible beep.

16. The gaming chip with built-in timer of claim 14, wherein said diameter is approximately thirty-six to forty millimeters (36–40 mm).

17. The gaming chip with built-in timer of claim 14, wherein said height is approximately three to five millimeters (3–5 mm).

18. The gaming chip with built-in timer of claim 14, wherein said timer further comprises:

a start button incorporated into said circular cylindrical body, wherein pressing said start button activates said timer;

a stop button incorporated into said circular cylindrical body, wherein pressing said stop button deactivates said timer; and a reset button incorporated into said circular cylindrical body, wherein pressing said reset button resets said timer.

19. The gaming chip with built-in timer of claim 14, wherein said timer further comprises:

a start/stop button incorporated into said circular cylindrical body, wherein pressing said start/stop button a first time activates said timer and pressing said start/stop button a second time deactivates said timer; and a reset button incorporated into said circular cylindrical body, wherein pressing said reset button resets said timer.

20. The gaming chip with built-in timer of claim 14, wherein said timer further comprises:

a start/stop/reset button incorporated into said circular cylindrical body, wherein pressing said start/stop/reset button a first time activates said timer, pressing said start/stop/button a second time deactivates said timer, and pressing said start/stop/button a third time resets said timer.

* * * * *